US005980395A

United States Patent [19]

Tsunoda et al.

[11] Patent Number: 5,980,395

[45] Date of Patent: Nov. 9, 1999

[54] HOLLOW SOLID GOLF BALL

[75] Inventors: Masaya Tsunoda, Akashi; Kiyoto Maruoka, Kobe; Akihiro Nakahara, Ibaraki, all of Japan

[73] Assignee: Sumitomo Rubber Industries, Ltd., Hyogo-Ken, Japan

[21] Appl. No.: 09/061,784

[22] Filed: Apr. 17, 1998

[30] Foreign Application Priority Data

Apr. 25, 1997 [JP] Japan ..... 9-108753
Nov. 20, 1997 [JP] Japan ..... 9-319928

[51] Int. Cl.[6] ..... A63B 37/06

[52] U.S. Cl. ..... 473/373; 473/375; 473/377

[58] Field of Search ..... 473/377, 372, 473/373, 375

[56] References Cited

U.S. PATENT DOCUMENTS 1,202,318 10/1916 Roberts ..... 473/377 X
5,150,906 9/1992 Molitor et al. ..... 473/377 X
5,833,554 11/1998 Sullivan et al. ..... 473/377 X

FOREIGN PATENT DOCUMENTS 9-308709 12/1997 Japan .
828774 2/1960 United Kingdom .
2319481 5/1998 United Kingdom .
9744098A1 11/1997 WIPO .
9802213A1 1/1998 WIPO .

*Primary Examiner*—George J. Marlo
*Attorney, Agent, or Firm*—Birch, Stewart, Kolasch & Birch, LLP

[57] ABSTRACT

The present invention provides a hollow, solid golf ball having improved shot feel at the time of hitting by improving the impact absorption, while maintaining excellent flight performance. The present invention relates to a hollow, solid golf ball comprising a hollow core and a cover formed on the core, wherein the hollow core is composed of a hollow portion having a diameter of 5 to 23 mm and a hollow core outer layer, and the hollow core outer layer has an elastic modulus of 265 to 985 kgf/cm$^2$.

10 Claims, 7 Drawing Sheets

DIAMETER OF HOLLOW PORTION: 10 mm

DIAMETER OF HOLLOW PORTION: 15 mm (1) DISTANCE FROM THE CENTER OF GOLF BALL TO PORTION (a)
= (RADIUS OF HOLLOW PORTION) + 3
(2) DISTANCE FROM THE CENTER OF GOLF BALL TO PORTION (b)
= [(RADIUS OF CORE) - (RADIUS OF HOLLOW PORTION)]/2
+ (RADIUS OF HOLLOW PORTION)
(3) DISTANCE FROM THE CENTER OF GOLF BALL TO PORTION (c)
= (RADIUS OF CORE) - 3

HOLLOW SOLID GOLF BALL

FIELD OF THE INVENTION

The present invention relates to a hollow solid golf ball. More particularly, it relates to a hollow solid golf ball having good shot feel at the time of hitting by improving impact absorption, while maintaining excellent flight performance.

BACKGROUND OF THE INVENTION

Hitherto, there have been mainly produced two types of golf balls. The one is a solid golf ball, such as a two-piece golf ball, which is composed of a core formed from integrally molded rubber material and a thermoplastic resin cover (e.g. ionomer resin cover) formed on the core. The other is a thread wound golf ball which is composed of a solid or liquid center, a thread rubber wound layer formed on the center and a cover of ionomer resin or balata etc. having a thickness of 1 to 2 mm covering on the thread rubber wound layer. The solid golf ball, when compared with the thread wound golf ball, has better durability and better flight performance because of larger initial velocity at the time of hitting and longer flight distance. Therefore, the solid golf ball is generally approved or employed by many golfers, mainly amateur golfers. On the other hand, the two-piece solid golf ball exhibits a hard shot feel at the time of hitting.

In order to improve the shot feel of the two-piece solid golf ball, it has been attempted to soften the cover or the core of the solid golf ball. However, the softening of the cover or core adversely sacrifices flight distance inherent in the two-piece solid golf ball. It has also been proposed that the core or cover is made of a plurality layered to improve shot feel. However, there is the drawback that production efficiency is poor, because the method of making the plural layered core or cover is complicated.

The present inventors have proposed a solid golf ball having a hollow at its center (Japanese Patent Kokai Publication No. 308709/1997). The hollow solid golf ball has a hollow portion having a diameter of 5 to 30 mm and the hollow portion is surrounded by rubber which is formed from a rubber composition which has been conventionally used for cores of solid golf balls. Because of the presence of the hollow portion, the weight of the golf ball is reduced. This reduction in the ball weight is compensated for by the addition of a high specific gravity metal powder to the rubber composition.

In the hollow golf ball, impact absorption is improved by making the core hollow, and thus shot feel is improved. The hollow golf ball also has excellent flight performance and maintains a long flight distance because the weight is distributed around the outer portion of the golf ball and the moment of inertia of the golf ball is increased, thus increasing the launch angle and reducing the spin amount immediately after hitting, but reducing spin attenuation. The hollow golf ball has excellent physical properties as described above, but the present inventors further try to improve the properties even more.

For example, impact absorption, which is one of important technical effects of the hollow golf ball, can be improved by enlarging the hollow portion. However, the enlargement of the hollow portion degrades the rebound characteristics and reduces flight distance. Also, it increases deformation of the cover or core outer layer at the time of hitting, thus reducing ball durability and degrading cut resistance.

OBJECTS OF THE INVENTION

A main object of the present invention is to provide a hollow solid golf ball having good shot feel at the time of hitting by improving impact absorption, while maintaining excellent flight performance.

According to the present invention, the object described above has been accomplished by adjusting the modulus of the hollow core outer layer to a specified range in the hollow solid golf ball comprising a hollow core composed of a hollow portion having a diameter of 5 to 23 mm and a hollow core outer layer, thereby providing a hollow, solid golf ball having good shot feel at the time of hitting by improving an impact absorption, while maintaining excellent flight performance.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

The present invention provides a hollow, solid golf ball comprising a hollow core and a cover formed on the core, wherein the hollow core is composed of a hollow portion having a diameter of 5 to 23 mm and a hollow core outer layer, and the hollow core outer layer has a modulus of 265 to 985 kgf/cm$^2$.

It is required that the hollow core outer layer is formed from a vulcanized molded rubber composition comprising a base rubber, a metal salt of unsaturated carboxylic acid, an organic peroxide and a filler, and the base rubber comprises not less than 90% by weight of polybutadiene containing a cis-1,4 bond of not less than 40% in the hollow solid golf ball of the present invention.

DETAILED DESCRIPTION OF THE INVENTION

Figure 1:
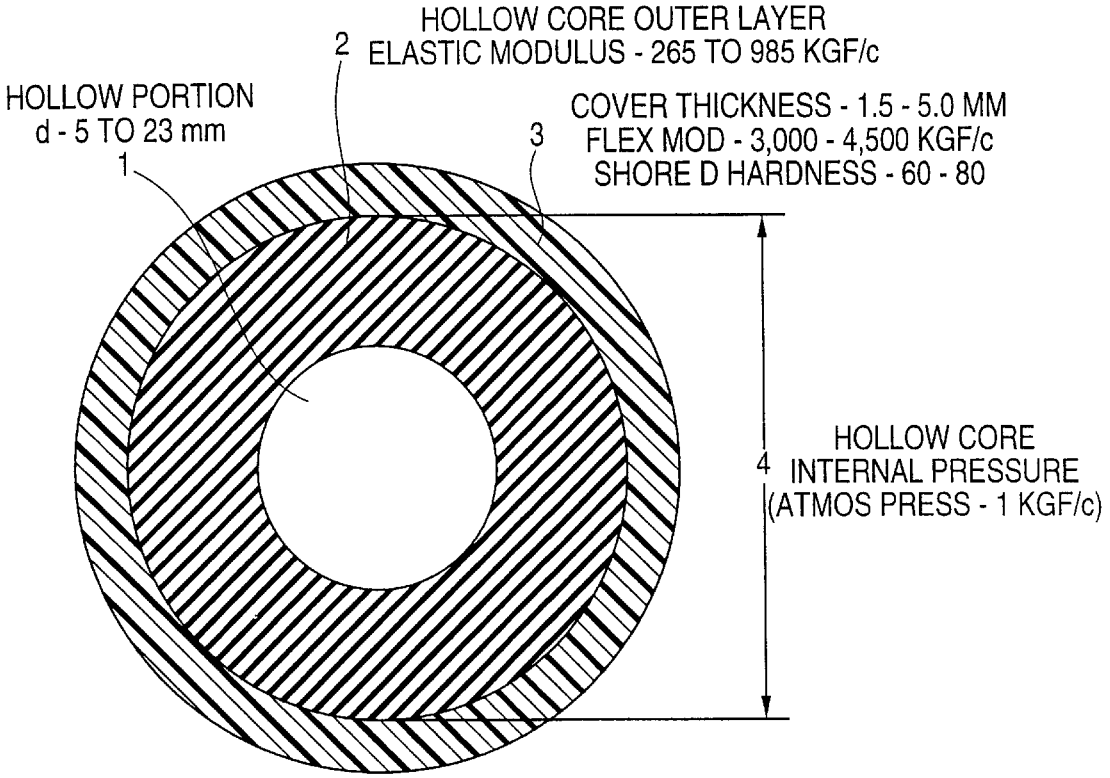
FIG. 1 is a schematic cross section illustrating one embodiment of the golf ball of the present invention.

The present invention will be described in detail hereinafter. FIG. 1 is a schematic cross section illustrating one embodiment of the hollow solid golf ball of the present invention. The golf ball of the present invention comprises a hollow core 4 which is composed of a hollow portion 1 and a hollow core outer layer 2, and a cover 3 formed on the core. The larger the diameter of the hollow portion, the larger the moment of inertia of the resulting golf ball. However, since the vulcanized molded article layer of rubber composition showing rebound characteristics in the core is reduced by the enlargement of the hollow portion, the diameter of the hollow portion is limited to a range of 5 to 23 mm, preferably 10 to 20 mm. When the diameter of the hollow portion is larger than 23 mm, a large amount of filler has to be formulated to the hollow core outer layer for adjusting the specific gravity of the golf ball. Therefore, the rebound characteristics are degraded which reduces flight distance. On the other hand, when the diameter of the hollow portion is smaller than 5 mm, the effects accomplished by the presence of the hollow, that is, the absorption of the impact force, the ability of maintaining the spin amount because of an enhancement in the moment of inertia and the like, are not obtained.

It is preferred that the core outer layer 2 has a modulus of 265 to 985 kgf/cm$^2$ in the golf ball of the present invention. The term "modulus" as used herein refers to a complex elastic modulus E* determined as follows. A rectangular parallelopiped sample of 4 mm (height)×4 mm (width)×2 mm (thickness) is cut from a specific portion in the core outer layer 2, and forcibly vibrated using a viscoelastic spectrometer manufactured by Rheology Co. at a compression mode, a frequency of 10 Hz and a heating rate of 4° C./min. to measure a vibration amplitude ratio and a phase lag between drive part and response part at 20° C., whereby a complex elastic modulus E* is determined. The specified portion from which the sample is cut varies depending on diameters of hollow portion and the like, but it is mainly portions indicated in Examples.

When the modulus is smaller than 265 kgf/cm$^2$, the rebound characteristics are degraded so as to reduce the flight distance. The flight distance is determined depending on the initial velocity, launch angle and spin amount. When the initial velocity and launch angle are large and the spin amount is small, the flight distance generally increases. In comparing the Examples with the Comparative Examples described later, when the modulus is smaller than 265 kgf/cm$^2$, the flight distance is reduced. This is because the launch angle is high but the initial velocity when hitting is too low in comparison with the high launch angle, so that the ball shows a high angle trajectory and drops with a short flight distance, thereby the flight distance is reduced. Therefore, the modulus is preferably not less than 265 kgf/cm$^2$, and in view of flight performance preferably not less than 455 kgf/cm$^2$, more preferably 635 kgf/cm$^2$. On the other hand, when the modulus is larger than 985 kgf/cm$^2$, the resulting golf ball is too hard and thus the shot feel is degraded, and the launch angle is too low and thus the flight distance is reduced. The impact absorption is also degraded. Therefore, the modulus is preferably not more than 985 kgf/cm$^2$, preferably not more than 790 kgf/cm$^2$, more preferably 715 kgf/cm$^2$ in order to improve impact absorption. When a long flight distance is required, the modulus is preferably within the range of 455 to 985 kgf/cm$^2$, more preferably 635 to 985 kgf/cm$^2$, and it is preferably 265 to 790 kgf/cm$^2$, more preferably 455 to 790 kgf/cm$^2$, most preferably 455 to 715 kgf/cm$^2$ in view of the balance of flight performance and impact absorption.

The wording "hollow core outer layer has a modulus of 265 to 985 kgf/cm$^2$", as used herein refers to the average of the modulus throughout the core outer layer falling within this range, but it is preferred that all values of the modulus throughout the core outer layer are substantially within the above range. It is preferable that the modulus is uniform from the inside to the outside of the core outer layer, or has a distribution wherein the modulus is larger from the inside to the outside of the core outer layer. The ratio of the modulus of the outer portion to that of the inner portion is preferably not less than 1.005, more preferably not less than 1.01. When the core outer layer has a modulus distribution increasing in order from the inside to the outside of the core outer layer, the spin amount can reduce without decreasing the initial velocity and therefore the initial condition of the resulting golf ball when struck hitting by a driver improves the flight distance. The distribution of modulus can be imparted to the core outer layer by, for example, a method of using different rubber formulations between the inner portion and outer portion of the core outer layer; a method of setting the location or temperature of the heat source or vulcanizing time so that the amount of heat for vulcanizing the inner portion and the outer portion of the core outer layer is different from each other; and the like.

The hollow core 4 is obtained by a method which comprises the steps of forming the rubber composition for the hollow core into a semi-spherical half shell in advance, and bonding two half shells together. The half shell is obtained by press-molding the rubber composition for the hollow core in a mold shown in FIG. 2 at 140 to 160° C., as a complete vulcanized article or semi-vulcanized article. The half shells may be bonded with adhesive. In the case of using a semi-vulcanized half shell, it is required to completely vulcanize it after bonding. The hollow core 4 has a diameter of 32 to 38 mm, and therefore the hollow core outer layer 2 has a thickness of 9 to 17 mm.

When making the hollow core 4, an internal pressure of the hollow portion 1 may be changed to approximately atmospheric pressure, higher than atmospheric pressure, or lower than atmospheric pressure. When the internal pressure of the hollow core 4 is higher than atmospheric pressure, or lower than atmospheric pressure, it is difficult to produce it, and a cost of production is high because of the use of complex production facilities, and therefore it is not very preferable. Particularly when the internal pressure of the hollow core 4 is lower than atmospheric pressure, there is the problem that the hollow core easily deforms at the step of covering it with the cover, and the like. On the other hand, when the internal pressure of the hollow core 4 is much higher than atmospheric pressure, the effect of improving the shot feel by the presence of the hollow portion is reduced. For the above reason, it is preferable that the internal pressure of the hollow core 4 in the resulting golf ball is approximately atmospheric pressure to 1 kgf/cm$^2$, preferably approximately atmospheric pressure to 0.5 kgf/cm$^2$, more preferably approximately atmospheric pressure. A method of encapsulating a gas in the core at atmospheric pressure shows the most excellent production efficiency, and therefore is preferable. The internal pressure of the hollow portion of the resulting golf ball of Examples and Comparative Examples is approximately atmospheric pressure, because the hollow golf ball is produced by encapsulating air in the hollow portion at atmospheric pressure. In this context, the wording "approximately atmospheric pressure" corresponds to a change of internal pressure occurring by the difference between the temperature of the encapsulating gas and the temperature of the resulting golf ball (ordinary temperature). Concretely, the temperature of the encapsulated gas can be controlled by controlling the temperature of the gas, the ambient temperature of the molding room or the temperature of the molding component. The production efficiency and cost of production are improved by adjusting the temperature to not more than 100° C., preferably not more than 50° C., considering the controllable temperature range. When the temperature change is 100° C., the internal pressure change is 40%. When the temperature change is 50° C., the internal pressure change is 20%. It is required to encapsulate air at a much higher temperature or a much lower temperature in order to impart a larger temperature difference, whereby production efficiency is degraded and the cost of production is high. For the above reason, the internal pressure of the resulting golf ball at ordinary temperature is within the range of atmospheric pressure±40%, preferably atmospheric pressure±20%.

The core outer layer 2 may have a single layer structure or multi-layer structure which has two or more layers. It preferably has a single layer structure because of easiness of production. For the hollow core outer layer 2, a rubber composition which has been conventionally used for solid golf balls is effectively used. The rubber composition comprises a base rubber, a metal salt of unsaturated carboxylic acid, an organic peroxide, a filler and the like.

The base rubber may be natural rubber and/or synthetic rubber which has been conventionally used for solid golf balls. Preferred is high cis-polybutadiene rubber containing a cis-1,4 bond of not less than 40%, preferably not less than 90%, more preferably not less than 95%. The polybutadiene rubber may be mixed with natural rubber, polyisoprene rubber, styrene-butadiene rubber, ethylene-propylene-diene rubber (EPDM), and the like. The base rubber preferably comprises not less than 90% by weight of the polybutadiene.

The metal salt of unsaturated carboxylic acid, which acts as a co-crosslinking agent, includes monovalent or divalent metal salts, such as zinc or magnesium salts of α,β-unsaturated carboxylic acids having 3 to 8 carbon atoms (e.g. acrylic acid, methacrylic acid, etc.). Preferred co-crosslinking agent is zinc acrylate because it imparts high rebound characteristics to the resulting golf ball. An amount of the metal salt of the unsaturated carboxylic acid in the rubber composition is 15 to 45 parts by weight, preferably from 25 to 35 parts by weight, based on 100 parts by weight of the base rubber. When the amount of the metal salt of the unsaturated carboxylic acid is larger than 45 parts by weight, the core is too hard, and thus shot feel is poor. On the other hand, when the amount of the metal salt of the unsaturated carboxylic acid is smaller than 15 parts by weight, the core is soft. Therefore, rebound characteristics are degraded to reduce flight distance. It may be adjusted to the amount which can impart the desired modulus to the resulting golf ball depending on diameter of the hollow portion, type of cover material and the like.

The organic peroxide, which acts as a crosslinking agent or a hardener, includes, for example, dicumyl peroxide, 1,1-bis(t-butylperoxy)-3,3,5-trimethyl cyclohexane, 2,5-dimethyl-2,5-di(t-butylperoxy)hexane, di-t-butyl peroxide and the like. Preferred organic peroxide is dicumyl peroxide. An amount of the organic peroxide is from 0.3 to 3.0 parts by weight, preferably 0.5 to 1.2 parts by weight, based on 100 parts by weight of the base rubber. When the amount of the organic peroxide is smaller than 0.3 parts by weight, the core is too soft. Therefore, rebound characteristics are degraded to reduce flight distance. On the other hand, when the amount of the organic peroxide is larger than 3.0 parts by weight, the core is too hard, and thus shot feel is poor.

The filler, which can be typically used for the core of the golf ball, includes for example, inorganic filler (such as zinc oxide, barium sulfate, calcium carbonate and the like), high specific gravity metal powder (such as tungsten powder, molybdenum powder, and the like), and a mixture thereof. Since the hollow core employed in the present invention has lighter weight than a conventional solid core because of the presence of the hollow portion, a combination of the inorganic filler and the high specific gravity metal powder is preferable. The amount of the filler is preferably from 20 to 80 parts by weight, based on 100 parts by weight of the base rubber. When the amount of the filler is smaller than 20 parts by weight, it is difficult to adjust a weight of the resulting golf ball. On the other hand, when the amount of the filler is larger than 80 parts by weight, a weight ratio of a rubber component in the core is too low. Therefore, the rebound characteristics of the resulting golf ball are degraded.

The rubber composition for the core of the present invention can optionally contain other components which have been conventionally used for preparing the core of solid golf balls, such as an antioxidant or a peptizing agent.

The cover 3 is then covered on the hollow core obtained as described above. The cover may be formed from thermoplastic resins which has been conventionally used for forming the cover of solid golf balls, such as an ionomer resin, balata and the like. An ionomer resin is preferred, in view of rebound characteristics. The cover used in the present invention may optionally contain the other resin in addition to the ionomer resin. An amount of the other resin is not more than 30 parts by weight, preferably not more than 10 parts by weight, based on 100 parts by weight of the ionomer resin. The ionomer resin is an ethylene-(meth) acrylic acid copolymer, of which a portion of carboxylic acid groups is neutralized with metal ion. The term "(meth) acrylic acid" as used herein refers to acrylic acid or methacrylic acid, or the mixture thereof. The metal ion which neutralizes a portion of carboxylic acid groups of the copolymer includes alkali metal ion, such as sodium ion, potassium ion, lithium ion and the like; divalent metal ion, such as zinc ion, calcium ion, magnesium ion, and the like; rivalent metal ion, such as aluminum ion, neodymium ion, and the like; and the mixture thereof. Preferred are sodium ion, zinc ion, lithium ion and the like, in view of rebound characteristics, durability and the like. The ionomer resin is not limited, but examples thereof will be shown by a trade name thereof. Examples of the ionomer resin, which is commercially available from Mitsui Du Pont Polychemical Co., include Hi-milan 1557, Hi-milan 1605, Hi-milan 1652, Hi-milan 1705, Hi-milan 1706, Hi-milan 1707, Hi-milan 1805, Hi-milan 1855 and Hi-milan 1856. Examples of the ionomer resin, which is commercially available from Exxon Chemical Co., include Iotec 7010, Iotec 8000, and the like. These ionomer resins are used alone or in combination.

The cover used in the present invention may optionally contain pigments (such as titanium dioxide, etc.), and the other additives such as an antioxidant, a UV absorber, a photostabilizer and a fluorescent agent or a fluorescent brightener, etc., in addition to the resin component, as long as the addition of the additives does not deteriorate the desired performance of the golf ball cover, but an amount of the pigment is preferably from 0.01 to 2 parts by weight based on 100 parts by weight of the cover resin component.

The cover used in the present invention is formed by a conventional method for forming golf ball cover well known in the art, such as injection molding, press-molding and the like. The cover has a thickness of 1.5 to 5.0 mm, preferably 2.5 to 5.0 mm, more preferably 3.2 to 4.5 mm. When the thickness of the cover is smaller than 1.5 mm, the hardness of the resulting golf ball is small, and thus rebound characteristics are degraded. When the thickness of the cover is larger than 5.0 mm, good impact absorption inherent to the hollow golf ball is not sufficiently exhibited, and thus the shot feel at the time of hitting is degraded. A resin having a flexural modulus of 3,000 to 4,500 kgf/cm$^2$, preferably 3,200 to 4,000 kgf/cm$^2$, more preferably 3,300 to 3,600 kgf/cm$^2$ is suitably used for the cover of the present invention. When the flexural modulus of the cover is smaller than 3,000 kgf/cm$^2$, the cover is too soft, and thus flight distance reduces. On the other hand, when the flexural modulus of the cover is larger than to 4,500 kgf/cm$^2$, the cover is too hard, and thus shot feel at the time of hitting is degraded. The cover has a Shore D hardness of 60 to 80, preferably 65 to 73, more preferably 68 to 71. When the Shore D hardness of the cover is smaller than 60, rebound characteristics are degraded. On the other hand, when the Shore D hardness of the cover is larger than to 80, shot feel at the time of hitting is degraded.

At the time of cover molding, many depressions called "dimples" may be typically formed on the surface of the golf ball. Furthermore, paint finishing or a marking stamp may be optionally provided after cover molding for serving commercial sales.

EXAMPLES

The following Examples and Comparative Examples further illustrate the present invention in detail but are not to be construed to limit the scope thereof.

Production of Hollow Core

Figure 2:
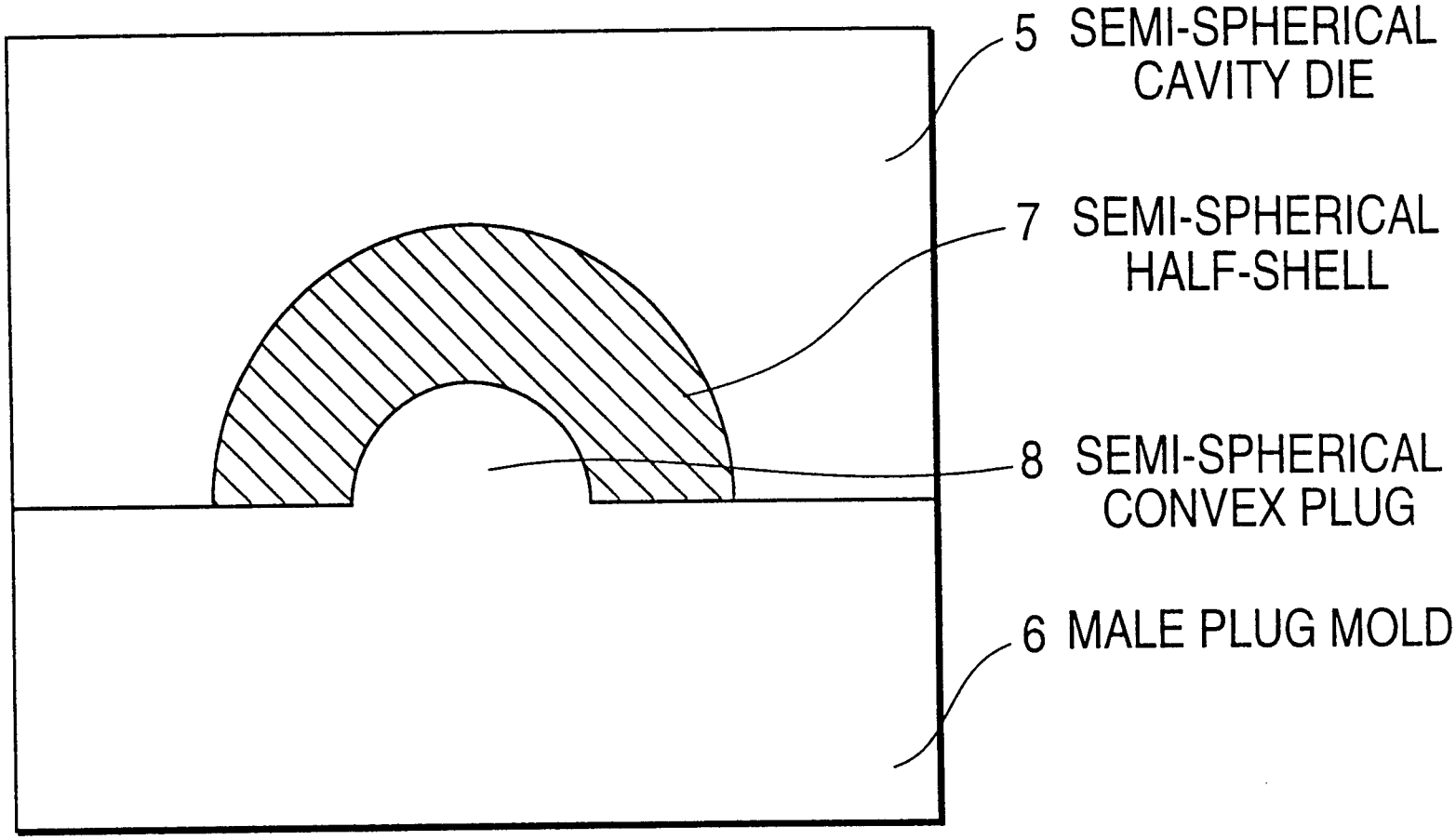
FIG. 2 is a schematic cross section illustrating one embodiment of the mold for molding the hollow core of the golf ball of the present invention.

A semi-spherical half-shell 7 was formed by mixing the following core rubber compositions A to G and I to O shown in Tables 1 to 4 and press-molding the mixture at the vulcanization condition shown in Tables 1 to 4 by using a semi-spherical cavity die 5 and a male plug mold 6 having a semi-spherical convex plug 8 having the same diameter with hollow portion shown in Tables 1 to 4, shown in FIG. 2, between hot platens of a press. Each hollow core is obtained by bonding the two semi-spherical half-shells with adhesive. Diameters of a hollow portion of the hollow core are shown in Tables 1 to 4. The modulus of the resulting hollow core was measured using the method (1) described later. The results are shown in Tables 1 to 4 with the average of the measurements.

Production of Solid Core

Figure 5:
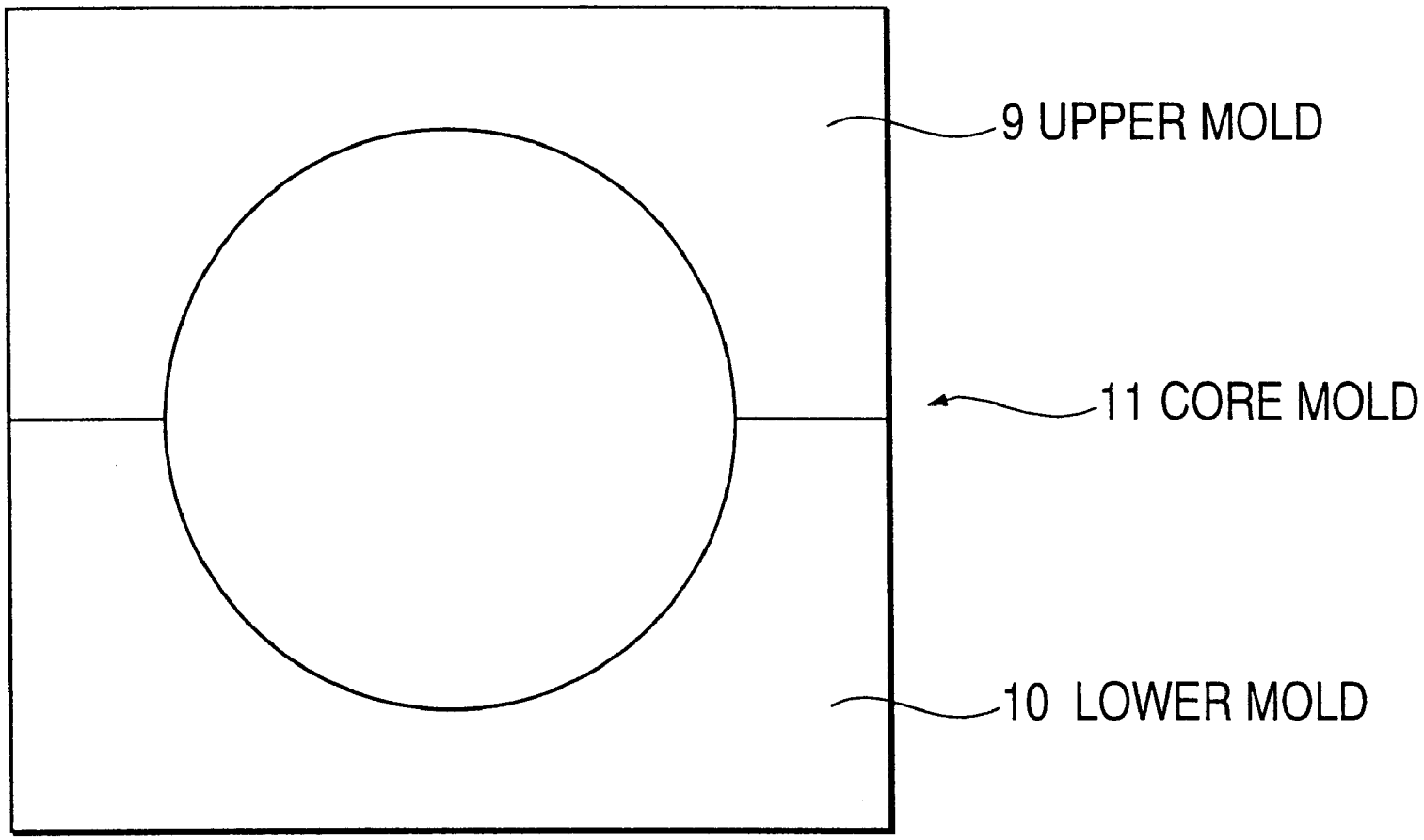
FIG. 5 is a schematic cross section illustrating one embodiment of the mold for molding the solid core.

Each solid core was obtained by mixing the following core rubber compositions H and P shown in Tables 2 and 4 respectively and press-molding the mixture at the vulcanization condition shown in Tables 2 and 4 by using a core mold 11 composed of an upper mold 9 and a lower mold 10 shown in FIG. 5. The modulus of the resulting solid core was measured using the method (1) described later. The results are respectively shown in Tables 1 and 4 with the average of the measurements.

TABLE 1

| Core composition | A | B | C | D |
|---|---|---|---|---|
| BR-18 *1 | 100 | 100 | 100 | 100 |
| Zinc acrylate | 25 | 25 | 25 | 25 |
| Zinc oxide | 52 | 52 | 52 | 52 |
| Antioxidant *2 | 0.5 | 0.5 | 0.5 | 0.5 |
| Dicumyl peroxide | 1.4 | 1.0 | 0.8 | 1.5 |

TABLE 1-continued

| Core composition | A | B | C | D |
|---|---|---|---|---|
| Diameter of hollow portion (mm) | 15 | 15 | 15 | 15 |
| Modulus of hollow core outer layer (kgf/cm$^2$) | | | | |
| Portion (a) | 611 | 448 | 261 | 711 |
| Portion (b) | 620 | 452 | 265 | 715 |
| Portion (c) | 625 | 458 | 268 | 719 |
| Average | 619 | 453 | 265 | 715 |
| Vulcanizing condition | 155° C. × 20 min | | | |

TABLE 2

| Core composition | E | F | G | H |
|---|---|---|---|---|
| BR-18 *1 | 100 | 100 | 100 | 100 |
| Zinc acrylate | 25 | 25 | 25 | 25 |
| Zinc oxide | 52 | 39.1 | 188 | 34 |
| Antioxidant *2 | 0.5 | 0.5 | 0.5 | 0.5 |
| Dicumyl peroxide | 0.7 | 0.9 | 1.4 | 1.0 |
| Diameter of hollow portion (mm) | 15 | 10 | 20 | — |
| Modulus of hollow core outer layer (kgf/cm$^2$) | | | | |
| Portion (a) | 202 | 416 | 626 | 398 |
| Portion (b) | 204 | 413 | — | 402 |
| Portion (c) | 208 | 426 | 635 | 408 |
| Average | 205 | 418 | 630 | 402 |
| Vulcanizing condition | 155° C. × 20 min | | | |

TABLE 3

| Core composition | I | J | K | L |
|---|---|---|---|---|
| BR-18 *1 | 100 | 100 | 100 | 100 |
| Zinc acrylate | 25 | 25 | 25 | 25 |
| Zinc oxide | 52 | 52 | 52 | 52 |
| Antioxidant *2 | 0.5 | 0.5 | 0.5 | 0.5 |
| Dicumyl peroxide | 1.9 | 1.7 | 1.4 | 2.3 |
| Diameter of hollow portion (mm) | 15 | 15 | 15 | 15 |
| Modulus of hollow core outer layer (kgf/cm$^2$) | | | | |
| Portion (a) | 981 | 786 | 632 | 1120 |
| Portion (b) | 985 | 790 | 635 | 1125 |
| Portion (c) | 990 | 794 | 639 | 1128 |
| Average | 985 | 790 | 635 | 1124 |
| Vulcanizing condition | 150° C. × 20 min | | | |

TABLE 4

| Core composition | M | N | O | P |
|---|---|---|---|---|
| BR-18 *1 | 100 | 100 | 100 | 100 |
| Zinc acrylate | 25 | 25 | 25 | 25 |
| Zinc oxide | 52 | 39.1 | 188 | 34 |
| Antioxidant *2 | 0.5 | 0.5 | 0.5 | 0.5 |
| Dicumyl peroxide | 1.2 | 1.5 | 2.1 | 1.5 |
| Diameter of hollow portion (mm) | 15 | 10 | 20 | — |
| Modulus of hollow core outer layer (kgf/cm$^2$) | | | | |
| Portion (a) | 513 | 741 | 1026 | 740 |
| Portion (b) | 518 | 743 | — | 732 |
| Portion (c) | 521 | 746 | 1031 | 744 |

TABLE 4-continued

| Core composition | M | N | O | P |
|---|---|---|---|---|
| Average | 517 | 743 | 1029 | 739 |
| Vulcanizing condition | | 150° C. × 20 min | | |

*1 Polybutadiene (trade name "BR-18") from JSR Co., Ltd., content of cis-1,4 bond = 98%
*2 Antioxidant (trade name "Yoshinox 425") from Yoshitomi Pharmaceutical Inds., Ltd.

Examples 1 to 11 and Comparative Examples 1 and 3

The hollow core obtained as described above was directly covered with the cover composition shown in Table 5 in a thickness of 3.8 mm by injection molding to obtain a hollow golf ball having a thickness of cover shown in Table 6 and Table 7 and a diameter of 42.8 mm. The weight of the resulting golf ball was adjusted to 45.4 g by varying an amount of zinc oxide. The initial velocity, spin amount, launch angle, flight distance, shot feel and impact force of the resulting golf ball was measured or evaluated. The results are shown in Table 6 and Table 7. The test methods are described later.

Comparative Examples 2 and 4

A solid golf ball was obtained as described in Examples 1 to 11 and Comparative Examples 1 and 3 with exception that a solid core was replaced with the hollow core. The properties of the resulting golf ball were evaluated as described in Examples 1 to 11 and Comparative Examples 1 and 3.

TABLE 5

| Kind | Amount (parts by weight) |
|---|---|
| Hi-milan 1605 *3 | 50 |
| Hi-milan 1706 *4 | 50 |
| Titanium dioxide | 2 |
| Flexural modulus (kgf/cm$^2$) | 3500 |
| Shore D hardness | 64 |

*3 Hi-milan 1605 (trade name), ethylene-methacrylic acid copolymer ionomer resin obtained by neutralizing with sodium ion, manufactured by Mitsui Du Pont Polychemical Co., Ltd., flexural modulus = 3,800 kgf/cm$^2$, Shore D hardness = 67
*4 Hi-milan 1706 (trade name), ethylene-methacrylic acid copolymer ionomer resin obtained by neutralizing with zinc ion, manufactured by Mitsui Du Pont Polychemical Co., Ltd., flexural modulus = 3,400 kgf/cm$^2$, Shore D hardness = 66

(Test method)

(1) Modulus

Figure 3:
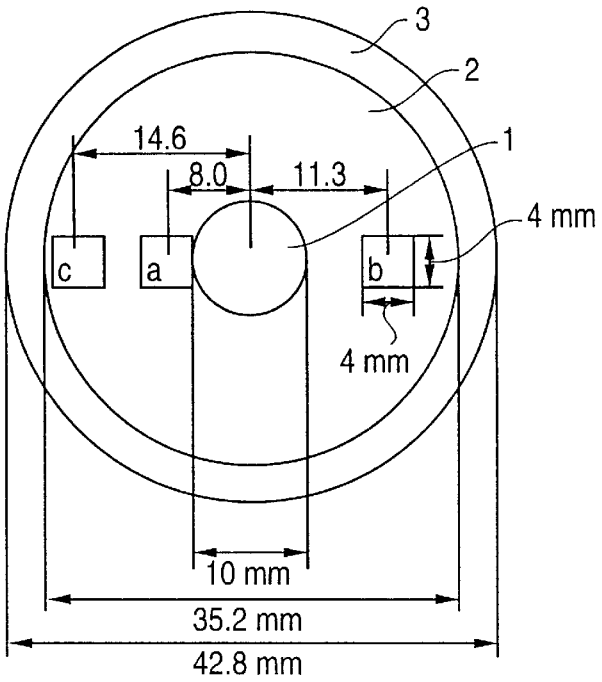
FIG. 3 is a schematic cross section illustrating the golf balls of the present invention having a diameter of 10 mm and 15 mm, showing the position from which the samples for measuring the modulus are cut.
Figure 3:
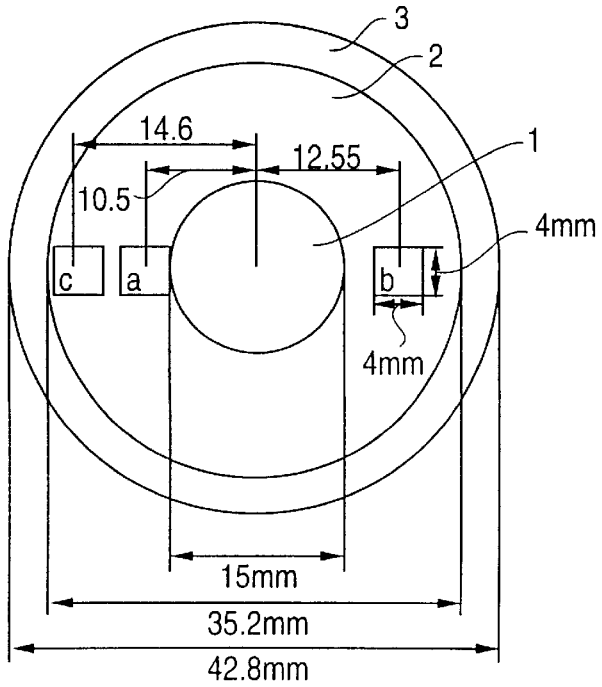
Figure 4:
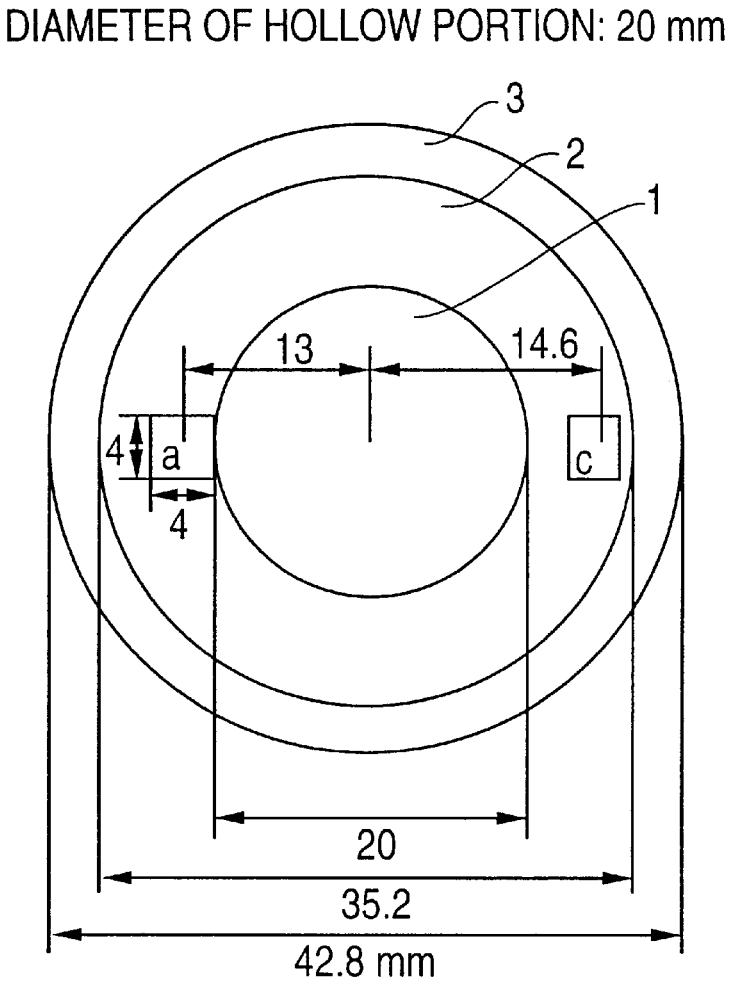
FIG. 4 is a schematic cross section illustrating the golf ball of the present invention having a diameter of 20 mm, showing the position from which the samples for measuring the modulus are cut.

A rectangular parallelopiped sample of 4 mm (height)×4 mm (width)×2 mm (thickness) is cut from portions (a), (b) and (c) shown in FIG. 3 (hollow core), FIG. 4 (hollow core) or FIG. 5 (solid core) depending on diameter of hollow portion or presence of hollow portion, and forcibly vibrated using a viscoelastic spectrometer manufactured by Rheology Co. at a compression mode, a frequency of 10 Hz and heating rate of 4° C./min. to measure a vibration amplitude ratio and a phase lag between drive part and response part at 20° C., whereby a complex elastic modulus E* was determined. The method of obtaining the distance from the center of the golf ball to portion (a), (b) or (c) is described in FIG. 4.

(2) Flight Performance

After a driver (a No. 1 wood club, trade name DP914, loft 9° manufactured by Sumitomo Rubber Industries, Co.) was mounted to a swing robot manufactured by True Temper Co. and the golf ball was hit at a head speed of 45 m/second, the initial velocity, spin amount, launch angle and flight distance (carry+run) was measured. As a flight distance, total (total distance) are measured. Carry is a distance to the dropping point of the hit golf ball, and run is a distance subtracted carry from total.

(3) Shot Feel

The impact at the time of hitting is evaluated in 5 steps by 10 amateur golfers having a handicap of not more than 10 according to a practical hitting test using a No. 1 wood club (driver). The scoring criteria are as follows.

(Scoring criteria)

5: Very soft and very good

4: Soft and good

3: Fairly good

2: Hard and poor

1: Very hard and very poor

The shot feel of the golf ball is evaluated by the evaluation criteria obtained from the average of the score evaluated by 10 golfers. The evaluation criteria are as follows.

(Evaluation criteria)

◎: 4.1 to 5.0

○: 3.1 to 4.0

Δ: 2.1 to 3.0

×: 1.1 to 2.0

(4) Impact Force

After a driver (a No. 1 wood club, trade name DP-10, loft 9° manufactured by Sumitomo Rubber Industries, Co.) was mounted to a swing robot manufactured by True Temper Co. and the golf ball was hit at a head speed of 43 m/second, the acceleration in the opposite direction of moving the golf club on impact is measured by an acceleration pickup attached to the side sole portion of the golf club head. The impact force was determined by changing the maximum value of the acceleration into force as represented by the following formula.

$$\text{Impact force} = M \times W$$

wherein M is the maximum acceleration at the time of hitting, and W is the weight of club head, which is 210 g.

(Test result)

TABLE 6

| Test item | Example 1 | 2 | 3 | 4 |
|---|---|---|---|---|
| Core composition | A | B | C | F |
| Diameter of hollow portion (mm) | 15 | 15 | 15 | 10 |
| Modulus of hollow core outer layer (average) (kgf/cm$^2$) | 619 | 453 | 265 | 418 |
| Thickness of cover(mm) | 3.8 | 3.8 | 3.8 | 3.8 |
| Initial velocity(m/sec) | 60.5 | 60.4 | 60.2 | 60.7 |
| Spin amount (rpm) | 3171 | 3092 | 3015 | 3181 |
| Launch angle (°) | 8.22 | 8.24 | 8.26 | 8.22 |
| Flight distance (yard) | 232.9 | 232.6 | 232.1 | 233.5 |
| Shot feel | ◎ | ◎ | ◎ | ◎ |
| Impact force (kg) | 1048 | 990 | 892 | 1008 |

TABLE 7

| Test item | Example 5 | Example 6 | Comparative Example 1 | Comparative Example 2 |
|---|---|---|---|---|
| Core composition | G | D | E | H |
| Diameter of hollow portion (mm) | 20 | 15 | 15 | — |
| Modulus of hollow core outer layer (average) (kgf/cm$^2$) | 630 | 715 | 205 | 402 |
| Thickness of cover(mm) | 3.8 | 3.8 | 3.8 | 3.8 |
| Initial velocity (m/sec) | 59.6 | 60.7 | 58.5 | 61.5 |
| Spin amount (rpm) | 3061 | 3210 | 3005 | 3302 |
| Launch angle (°) | 8.26 | 8.21 | 8.32 | 7.89 |
| Flight distance (yard) | 232.1 | 233.2 | 222.3 | 229.5 |
| Shot feel | ◎ | ○ | ◎ | x |
| Impact force (kg) | 962 | 1075 | 793 | 1301 |

TABLE 8

| Test item | Example 7 | Example 8 | Example 9 | Example 10 |
|---|---|---|---|---|
| Core composition | I | J | K | N |
| Diameter of hollow portion (mm) | 15 | 15 | 15 | 10 |
| Modulus of hollow core outer layer (average) (kgf/cm$^2$) | 985 | 790 | 635 | 743 |
| Thickness of cover(mm) | 3.8 | 3.8 | 3.8 | 3.8 |
| Initial velocity(m/sec) | 61.2 | 60.8 | 60.6 | 61.1 |
| Spin amount (rpm) | 3341 | 3268 | 3220 | 3362 |
| Launch angle (°) | 8.17 | 8.20 | 8.21 | 8.18 |
| Flight distance (yard) | 233.2 | 233.0 | 233.2 | 233.1 |
| Shot feel | Δ | ○ | ○ | ○ |
| Impact force (kg) | 1085 | 1083 | 1060 | 1102 |

TABLE 9

| Test item | Example 11 | Comparative Example 3 | Comparative Example 4 |
|---|---|---|---|
| Core composition | M | L | P |
| Diameter of hollow portion(mm) | 15 | 15 | — |
| Modulus of hollow core outer layer (average)(kgf/cm$^2$) | 517 | 1124 | 739 |
| Thickness of cover (mm) | 3.8 | 3.8 | 3.8 |
| Initial velocity (m/sec) | 60.4 | 61.9 | 61.7 |
| Spin amount (rpm) | 3133 | 3510 | 3850 |
| Launch angle (°) | 8.22 | 8.08 | 7.71 |
| Flight distance (yard) | 232.8 | 220.1 | 230.4 |
| Shot feel | ◎ | x | x |
| Impact force (kg) | 1015 | 1230 | 1420 |

As is apparent from the comparison of the physical properties of the golf balls of Examples 1 to 11 shown in Tables 6 to 9 with those of the conventional golf balls of Comparative Examples 1 to 3 shown in Tables 7 and 9, the solid golf balls of Examples 1 to 11 using the hollow core having a modulus of the hollow core outer layer of 265 to 985 kgf/cm$^2$ have better shot feel at the time of hitting than the conventional hollow solid golf ball of Comparative Examples 1 of which the hollow core outer layer has low modulus and the conventional hollow solid golf ball of Comparative Examples 3 of which the hollow core outer layer has high modulus, by improving impact absorption, while keeping excellent flight performance. The solid golf balls of Comparative Examples 2 and 4 which have not hollow portion have poor flight performance, and have poor shot feel because of large impact force. As is apparent from the comparison of the physical properties of the golf balls of Examples 1 to 3 with those of Examples 6 to 9, both having a diameter of the hollow portion of 15 mm, the golf balls of Examples having a modulus of the hollow core outer layer of not less than 453 kgf/cm$^2$, preferably not less than 619 kgf/cm$^2$ have longer flight distance than others. The golf balls of Examples having a modulus of the hollow core outer layer of not more than 790 kgf/cm$^2$ have better shot feel than others.

Figure 6:
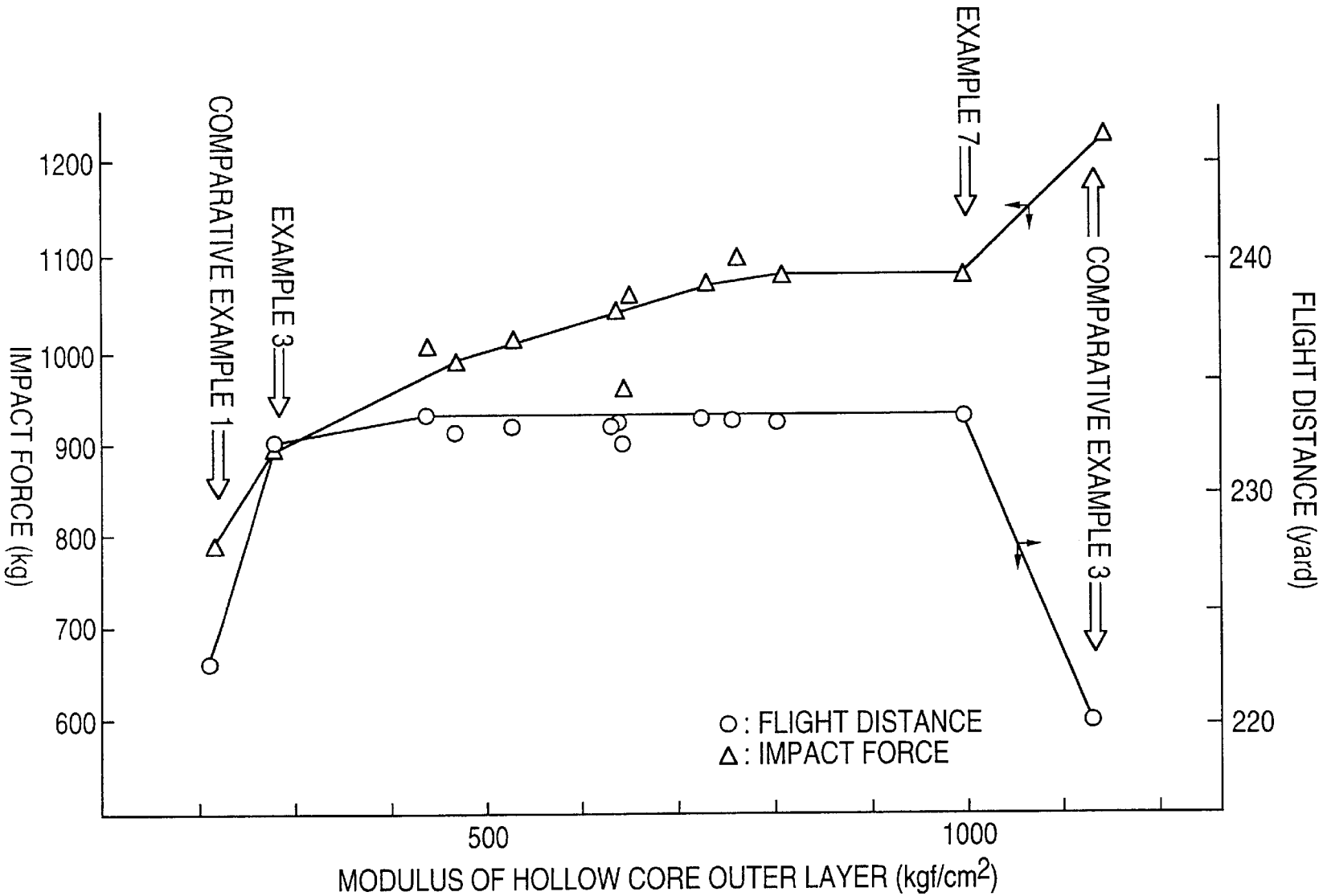
FIG. 6 is a graph illustrating the correlation of modulus of the hollow core outer layer with flight distance and impact force of the resulting golf ball.
Figure 7:
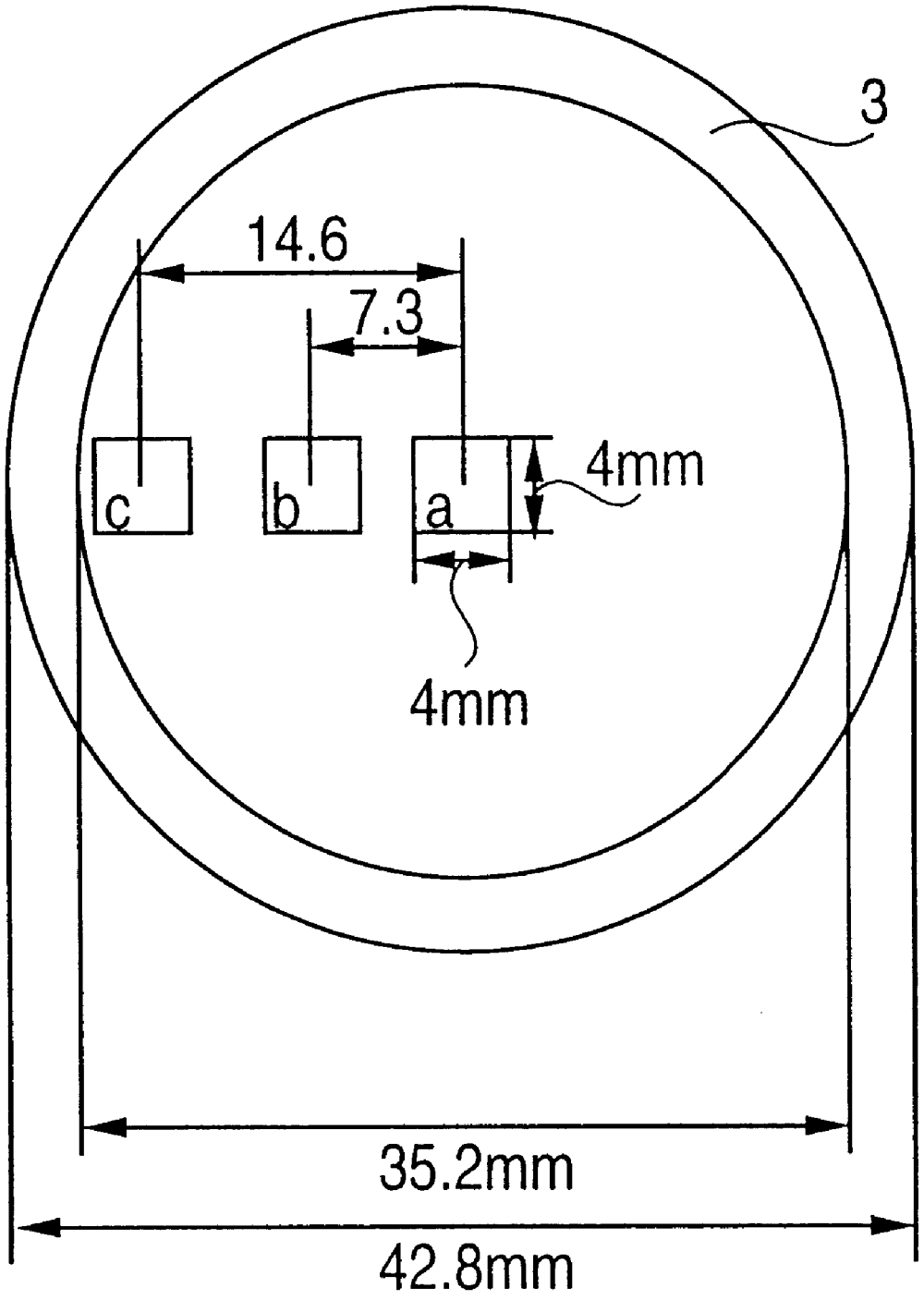
FIG. 7 is a schematic cross section illustrating the solid golf ball, showing the position from which the samples for measuring the modulus are cut.

FIG. 6 is a graph illustrating the correlation of modulus of the hollow core outer layer with flight distance and impact force of the resulting golf ball, with regard to the hollow solid golf balls of Examples 1 to 11 and Comparative Examples 1 and 3. In FIG. 6, the abscissa axis refers to average of modulus of the hollow core outer layer, and the ordinate axis refers to impact force and flight distance. As is apparent from FIG. 6, when the modulus of the hollow core outer layer is smaller than that of Example 3 which is 265 kgf/cm$^2$, the flight distance of the resulting golf ball suddenly reduces. On the other hand, when the modulus is larger than that of Example 7 which is 985 kgf/cm$^2$, the flight distance of the resulting golf ball suddenly reduces. This is for the above reason that when the modulus is smaller than 265 kgf/cm$^2$, the launch angle is high and the initial velocity is low to drop the golf ball at a short flight distance with creating a high angle trajectory, thereby the flight distance reduces. On the other hand, when the modulus is larger than 985 kgf/cm$^2$, the launch angle is low, and thus the flight distance reduces. Therefore, it is required that the modulus is within the range of 265 to 985 kgf/cm$^2$.

When the modulus of the hollow core outer layer is larger than 985 kgf/cm$^2$, the impact force of the resulting golf ball suddenly increases to degrade the impact absorption largely, and thus the shot feel is degraded. Therefore, it is required that the modulus is not more than 985 kgf/cm$^2$. As is apparent from the result described above, it is required that the modulus of the hollow core outer layer is within the range of 265 to 985 kgf/cm$^2$, considering the valance of flight distance and impact absorption.

What is claimed is:

1. A golf ball comprising a hollow core having a hollow portion and a hollow core outer layer surrounding said hollow portion, and a cover formed on said hollow core outer layer, said hollow portion having a diameter of 5 to 23 mm and said hollow core outer layer having an elastic modulus of 265 to 985 kgf/cm$^2$.

2. The golf ball according to claim 1, wherein the cover has a thickness of 1.5 to 5.0 mm.

3. The golf ball according to claim 1, wherein the hollow core outer layer is formed from a vulcanized molded rubber composition comprising a base rubber, a metal salt of unsaturated carboxylic acid, an organic peroxide and a filler, and the base rubber comprises not less than 90% by weight of polybutadiene containing a cis-1,4 bond of not less than 40%.

4. The golf ball according to claim 1, wherein the hollow portion has a diameter of 10 to 20 mm.

5. The golf ball according to claim 1, wherein the hollow core has an internal pressure of from approximately atmospheric pressure to 1 kgf/cm$^2$.

6. The golf ball according to claim 1, wherein the hollow core has an internal pressure of from approximately atmospheric pressure to 0.5 kgf/cm$^2$.

7. The golf ball according to claim 1, wherein the hollow core outer layer is a multi-layer structure.

8. The golf ball according to claim 1, wherein the hollow core outer layer contains rubber and a combination of an inorganic filler and a high specific gravity metal powder.

9. The golf ball according to claim 8, wherein the filler is selected from the group consisting of zinc oxide, barium sulfate and calcium carbonate and the high specific gravity metal powder is selected from the group consisting of tungsten powder and molybdenum powder.

10. The golf ball according to claim 1, wherein the cover is made of a resin having a flexural modulus of 3,000 to 4,500 kgf/cm$^2$ and a Shore D hardness of 60 to 80.

* * * * *